United States Patent [19]

Arai et al.

[11] Patent Number: 4,540,911

[45] Date of Patent: Sep. 10, 1985

[54] HALOGEN LAMP UNIT

[75] Inventors: Tetsuji Arai; Tatsushi Igarashi, both of Hyogo, Japan

[73] Assignee: Ushio Denki Kabushiki Kaisha, Tokyo, Japan

[21] Appl. No.: 438,788

[22] Filed: Nov. 3, 1982

[51] Int. Cl.[3] ..... H01J 1/02

[52] U.S. Cl. ..... 313/44; 313/36

[58] Field of Search ..... 362/218; 313/36, 44, 313/579

[56] References Cited

U.S. PATENT DOCUMENTS

| | | | |
|---|---|---|---|
| 3,634,722 | 1/1972 | Palmer et al. | 313/579 |
| 3,936,672 | 2/1976 | Tanaka | 362/32 |
| 4,047,496 | 9/1977 | McNeilly et al. | 118/725 |

*Primary Examiner*—David K. Moore

*Attorney, Agent, or Firm*—Ziems, Walter & Shannon

[57] ABSTRACT

Disclosed herein is a halogen lamp unit comprising a tubular halogen lamp having at its both ends sealed portions hermetically enclosing their respective conductive members. The halogen lamp is supported by holders at its tubular outer wall portions of the envelope adjacent to the sealed end portions without base shells which cover the sealed portions. The holders are cooled by a water-cooling system. The sealed end portions of the lamp are kept in a bare state, thereby avoiding the degradation of the conductive members due to the oxidation thereof. The sealed end portions may be exposed in air-paths to the cooling wind flowing along the tubular halogen lamp.

1 Claim, 6 Drawing Figures

HALOGEN LAMP UNIT

BACKGROUND OF THE INVENTION

1. Field of the Invention

This invention relates to a halogen lamp unit, and more particularly to a halogen lamp unit formed of tubular halogen lamps, holders for holding the halogen lamps, and a water-cooling system for cooling the holders.

2. Description of the Prior Art

Among a variety of apparatus adapted to carry out heat treatments therein, radiant heating furnaces in which light radiated from a lamp or lamps irradiates objects or materials to be treated for heat treatment have the following merits:

(1) Owing to an extremely small heat capacity of a lamp per se, it is possible to raise or lower the heating temperature promptly;

(2) The heating temperature can be easily controlled by controlling the electric power to be fed to the lamp;

(3) Since they feature indirect heating by virtue of light radiated from their lamps which are not come into contact with the objects, there is little danger of contaminating objects under heat treatment;

(4) They enjoy less energy consumption because full-radiation-state operations of the lamps are feasible in a short time periods after turning the lamps on and the energy efficiencies of the lamps are high; and (5) They are relatively small in size and inexpensive compared with conventional resistive furnaces and high-frequency heating furnaces.

Such radiant heating furnaces have been used for the heat treatment and drying of steel materials and the like and the molding of plastics as well as in thermal characteristics testing apparatus and the like. Use of radiant heating furnaces have, particularly recently, been contemplated to replace the conventionally-employed resistive furnaces and high-frequency heating furnaces for heat treating of semiconductor wafers, such as, for example, drive-in diffusion processes, chemical vapor deposition processes, annealing processes of ion-implanted damages and thermal processes for nitrifying or oxidizing the surfaces of silicon wafers. As reasons for the above move, using a radiant heating furnace, it is possible to activate the ion-implanted atoms with minimal redistribution because heat treating of the wafers at a higher temperature can be achieved in a shorter period of time, in addition to the advantages, such as little contamination, less power consumption, etc. Minimal redistribution of dopant implanted results in steeper and shallower junctions meaning potentially smaller and faster devices. Another reason is that with increasing the semiconductor wafer size uniform heat treating by conventional resistive furnace is more difficult.

As lamps in such a radiant heating furnace, halogen lamps are used because they can generate light of a large irradiation energy. Especially, elongated tubular halogen lamps are suitably used owing to their long radiation lengths. Generally, each of such elongated tubular halogen lamps is supported via its base shells, which are provided to cover the sealed portions of the sealed envelope which hermetically enclose their respective conductive members at its both ends. An example of such halogen lamps is illustrated in FIG. 1. Within the sealed portion 12 at each end of a sealed body 11 of a halogen lamp 10, a conductive member 13 made of a metal foil is hermetically sealed. The conductive member 13 is connected with an outer lead 14 and inner lead 15 which extend respectively to the outside of the sealed body 11 and to the interior of the sealed body 11. The inner lead 15 is connected to a filament 16. A cylindrical base shell 50 is fixedly applied by means of an insulating bond 51 in such a way as the base shell 50 covers the sealed portion 12. The base shell 50 is fixedly provided with a pin 52, to which the outer lead 14 is electrically connected. The lamp 10 is held in place by fixing the pins 52 on supports such as sockets (not shown).

In the above construction, each sealed portion 12 is covered by the base shell 50 and heat is not allowed to dissipate from the sealed portion 12, thereby making the conductive member 13 hot due to heat from the filament 16 and accelerating its oxidation and thus resulting in a drawback that the conductive member 13 is burnt out in an early stage of its application.

Provision of base shells 50 causes such dusts as fragments of the bond 51 to be scattered around. Such dusts will give serious deleterious influence to objects under treatment, if the objects have sensitive characteristics as semiconductor materials.

SUMMARY OF THE INVENTION

The present invention has been completed with the foregoing in view. An object of this invention is to provide a halogen lamp unit which permits its holding without need for base shells and enjoys a long service life.

According to this invention, there is thus provided a halogen lamp unit which comprises a tubular halogen lamp provided at its both ends sealed portions with hermetically enclosing their respective conductive members, holders adapted to hold the halogen lamp in place at its tubular outer wall portions adjacent to the sealed portions, and a water-cooling system for cooling the holders.

Owing to the above construction, the halogen lamp unit according to this invention can be held in place without need for base shells. Thus, the sealed end portions of its halogen lamp promote effective release or dissipation of heat therefrom, coupled with the cooling system, leading to a longer service life of the halogen lamps. In addition, owing to the exclusion of base shells, no dust of the bond is caused to scatter around and objects, which will be treated using the halogen lamp unit, will be protected from contamination by such dust.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENT

Figure 2:
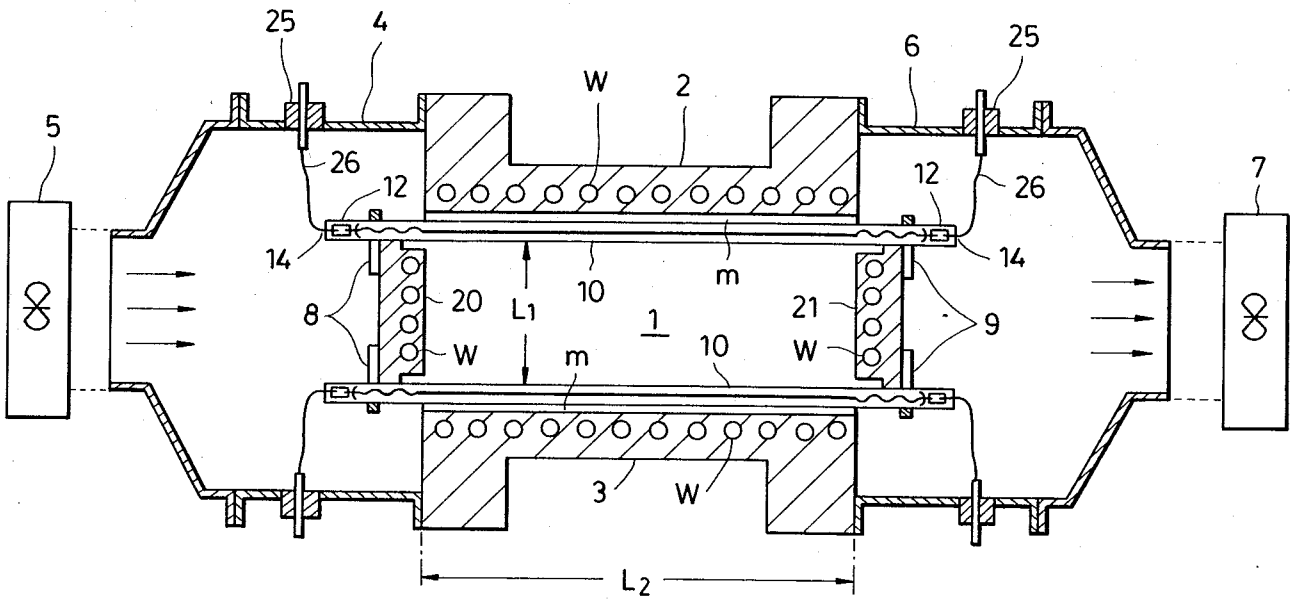
FIG. 2 is a schematic cross-sectional view of a radiant heating furnace according to one embodiment of this invention.
Figure 3:
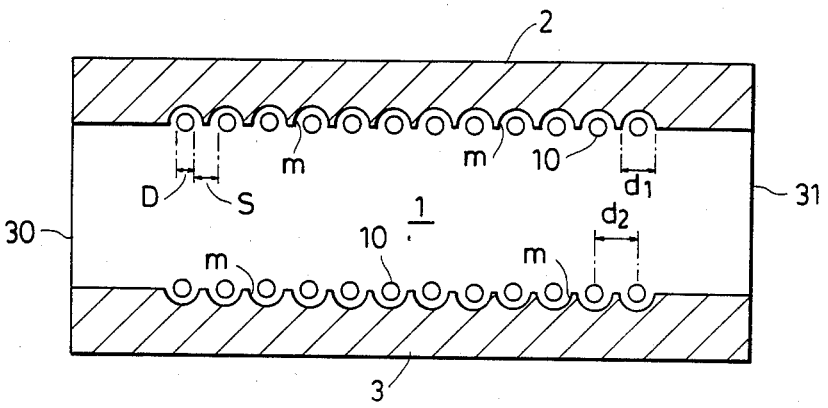
FIG. 3 is a simplified, cross-sectional, side view of the lamps and mirrors shown in FIG. 2.

FIG. 2 illustrates the construction of a radiant heating furnace to which halogen lamp units according to this invention are applied. In the present embodiment, as also shown in FIG. 3, main mirrors 2 and 3 are arranged in such a way that they cover respectively the upper and lower boundaries of an irradiation space 1 in which an object to be treated is placed. The reflecting surface of each of these main mirrors 2 and 3 defines a plurality of semicircular grooves m which are parallel and close to one another. These grooves m extend over the entire longitudinal length of each of the main mirrors 2 and 3 (namely, in the horizontal direction in FIG. 2 but in the direction perpendicular to the drawing sheet in FIG. 3). At longitudinally one end of the main mirrors 2 and 3, there is coupled a first air-path member 4 which is in turn connected to a blower 5. On the other hand, the main mirrors 2 and 3 terminate at longitudinally the other end thereof in a second air-path member 6 which is connected to an exhauster 7. Near the outlet of the first air-path member 4 and adjacent to the inlet of the second air-path member 6, there are provided lamp supports 8 and 9, respectively. The former lamp support 8 corresponds to the one end of the main mirrors 2 and 3 and the latter lamp support 9 corresponds to the other end of the same main mirrors 2 and 3. These lamp supports 8 and 9 support their corresponding end portions of elongated, tubular halogen lamps 10 which extend along their corresponding gutter-like grooves m in the main mirrors 2 and 3. Therefore, in proximity to the upper main mirror 2, a plurality of lamps 10 are disposed closely with each other with the longitudinal axes thereof extending parallelly in a plane along the upper main mirror 2 thereby forming an upper plane light source unit which faces the irradiation space 1, and in proximity to the lower main mirror 3, a lower plane light source unit which also faces the irradiation space 1 having the same arrangement of lamps 10 as in the upper plane light source unit. The lamps 10 are spaced from one another by a distance S between each two adjacent lamps.

Figure 4:
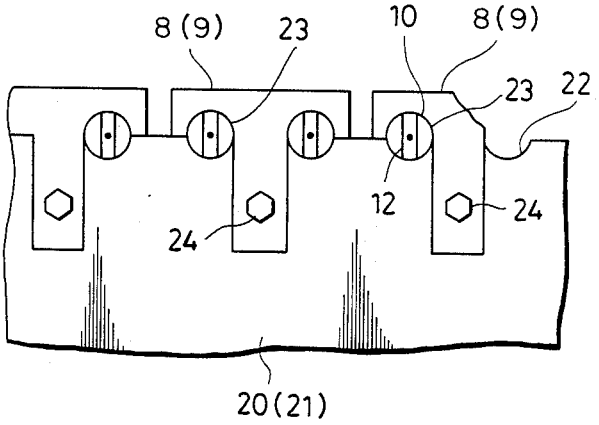
FIG. 4 is a schematic, fragmentary view of each support member of the halogen lamp unit of FIG. 2.

As shown in FIG. 4, the lamp supports 8 and 9 are fixed by means of screws 24, onto side mirrors 20 and 21, respectively, which are disposed to cover up both sides of the irradiation space 1 and are provided with mirrored surfaces on their inner walls. Along the upper and lower edges of each of the side mirrors 20 and 21, the lamp supports 8 and 9 hold at their serrated holding parts 23 lamps 10 at their tube-shaped parts adjacent to their corresponding sealed portions 12 and 12, in association with their corresponding lamp-receiving serrations 22 formed in the side mirrors 20 and 21 at locations in correspondence with the grooves m. Therefore, as depicted in FIG. 2, the sealed portions 12 and 12 of each lamp 10 are exposed out of the irradiation space 1, in other words, they are positioned in the first air-path member 4 and second air-path member 6. Outer leads 14 and 14, which extend outwardly from the sealed portions 12 and 12 thus exposed, are connected to current feed lines 26 and 26 extending through the walls of the first and second air-path members 4 and 6 with insulators 25 and 25 such as Teflon or the like applied therebetween.

Furthermore, the main mirrors 2 and 3 and side mirrors 20 and 21 are each provided with a water-cooling system. More specifically, each of the main mirrors 2 and 3 and side mirrors 20 and 21 defines water channels W which extend through its body. These water channels W are communicated with a cooling water supply system (not shown).

Figure 5:
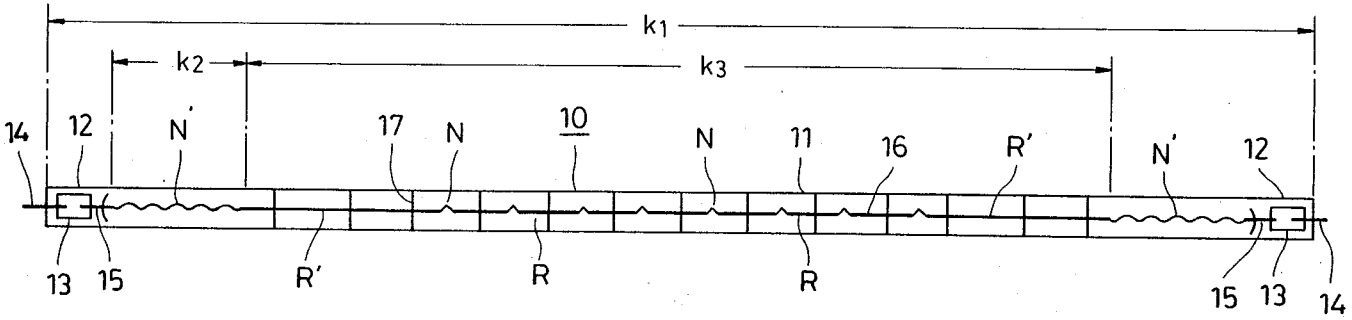
FIG. 5 is a schematic, cross-sectional view of an example of a halogen lamp.

In the above embodiment, each of the lamps 10 is, as shown in FIG. 5, made of a sealed tubular body 11 made of translucent quartz, conductive members 13 and 13 made of metal foils and sealed in their respective sealed portions 12 and 12 formed respectively at both ends of the sealed body 11, outer leads 14 and 14 extending from the conductive members 13 and 13 to points outside the sealed body 11, internal leads 15 and 15 extending from the conductive members 13 and 13 to the interior of the sealed body 11, filament 16 connected at both ends thereof to the inner leads 15 and 15 and disposed along the longitudinal axis of the sealed tubular body 11, and filament supporters 17. The filament 16 is provided alternatingly with nonluminous portions N,N and luminous portions R,R,R',R' and is provided at both ends thereof non-luminous end portions N' and N'.

Figure 1:
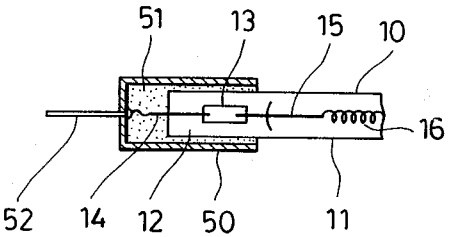
FIG. 1 is a fragmentary cross-sectional view of a conventional halogen lamp unit.

Next, exemplary specific figures will be given. Each of the grooves m of the main mirror 2 and 3 has a semicircular shape and its diameter $d_1$ is 20 mm. The distance $d_2$ between the centers of each two adjacent semicircular grooves m is 21 mm. Each lamp 10 has a total length $k_1$ of 335 mm. The sealed body 11 has an external diameter D of 10 mm at its tubular portion. The nonluminous end portions N' and N' of the filament 16 have individually a length $k_2$ of 37 mm. The length $k_3$ of the filament 16 without the nonluminous end portions N' and N' is 230 mm. The lamps 10 are each rated as 230 V–3200 W. The upper lamps 10 are separated through the irradiation space 1 from their corresponding lower lamps 10 by a distance $L_1$ of 80 mm. The distance $L_2$ between the side mirrors 20 and 21 is 230 mm. The lamps 10 are arranged in such a way that their longitudinal axes lie at positions displaced from the centers of the corresponding semi-circular grooves m by from 1 to 2 mm toward the corresponding main mirror 2 or 3. The blower 5 and exhauster 7, which are coupled respectively to the first air-path member 4 and the second air-path member 6, have a maximum air current of 8 $m^3$/min. Thus, upon turning on the lamps 10, light radiated from the lamps 10 is irradiated into the irradiation space 1, together with those reflected at the main mirrors 2 and 3 and side mirrors 20 and 21. Then, an object to be treated is placed within the irradiation space 1 by means of a conveyance mechanism such as belt conveyor or the like so that the object is caused to pass through openings 30 and 31 (see, FIG. 3) in a direction perpendicular to the drawing sheet in FIG. 1, thereby effecting the heat treatment of the object. In order to avoid undesirable influences to the heating characteristics of the object due to the cooling wind, a translucent vessel or case made of transparent quartz, for example, may be provided in the irradiation space 1 in which the object is placed or through which the object is conveyed.

In the above embodiment, each lamp 10 is forcedly cooled along its entire length by the wind, which flows along the sealed body 11 of the lamp 10 from one end thereof located in the vicinity of the outlet of the first air-path member 4 owing to the provision of the blower 5, and by the wind which flows along the sealed body of the lamp 10 toward the other end thereof located in the proximity of the inlet of the second air-path member 6 owing to the provision of the exhauster 7. At the same time, the main mirrors 2 and 3 are also cooled over their entire lengths. Thus, by controlling the air current of the blower 5 and that of the exhauster 7 at the same or similar level, the sealed body 11 of each of the lamps 10 and the main mirrors 2 and 3 can be equally cooled in their lengthwise direction under good conditions, whether an object is existed for its treatment in the irradiation space 1 or not. Since the sealed portions 12 and 12 of each lamp 10 are positioned outwardly beyond their corresponding side mirrors 20 and 21, they do not receive direct light from other lamps; less heat is transmitted from the central portion of the sealed body 11 of the lamp 10 to the sealed portions 12 and 12 owing to the holding of the lamp 10 at its tubular wall portions embracing the non-luminous end portions N′ and N′ of the filament 16 by their corresponding side mirrors 20 and 21, which are provided with the water-cooling systems and the lamp supports 8 and 9 which cooperate with their corresponding side mirrors 20 and 21; and the sealed portions 12 and 12 are effectively cooled owing to their exposure in the first and second air-path members 4 and 6. Consequently, the sealed portions 12 and 12 of the lamp 10 are protected from degradation.

Each of the halogen lamp units according to this invention has adopted, without depending on the prior art lamp-supporting means in which base shells are provided on both sealed end portions and the lamp is supported or held via the base shells, a new lamp-supporting means in which the tubular wall portions of the halogen lamp are supported by supports equipped with a water-cooling system. The latter lamp-supporting means has not been thought of at all from the conventional lamp-supporting concept. Namely, each of the lamps 10 is supported or held at its wall portions adjacent to the sealed end portions 12 and 12 of its sealed body 11 by means of the lamp supports 8 and 9. Therefore, the sealed portions 12 and 12 are kept exposed in a bare state and heat can be effectively released or dissipated from the sealed portions 12 and 12. This protects the conductive members 13 and 13 sealed in the sealed portions 12 and 12 from oxidation due to the increase of temperature thereby avoiding the reduction in service life of the lamps. The above advantage may be enhanced further when the sealed portions 12 and 12 are placed in cooled air-paths. The lamp supports 8 and 9, supporting the lamps 10, can be forcedly cooled also by heat conduction of the water-cooled side mirrors 20 and 21 which are in contact with the lamp supports 8 and 9. Accordingly, the lamp supports 8 and 9 are kept free from deleterious influence such as thermal deformation or the like. In the case that a halogen lamp of a large output such as mentioned above is used as the lamp 10, the temperatures of the portions at which the lamp is supported will not drop below 120° C., and then the halogen cycle will not suppressed in each halogen lamp.

In addition, when subjecting a semiconductor wafer to heat treatment in a radiant heating furnace equipped with lamps having base shells, such dusts as fragments of their bond will be produced and will give serious deleterious influence to the characteristics of the semiconductor wafer. However, the radiant heating furnace equipped with the halogen lamp unit according to this invention is free from such problem because at the sealed portions 12 and 12 of each lamp 10 no base shells and no bond are used.

Figure 6:
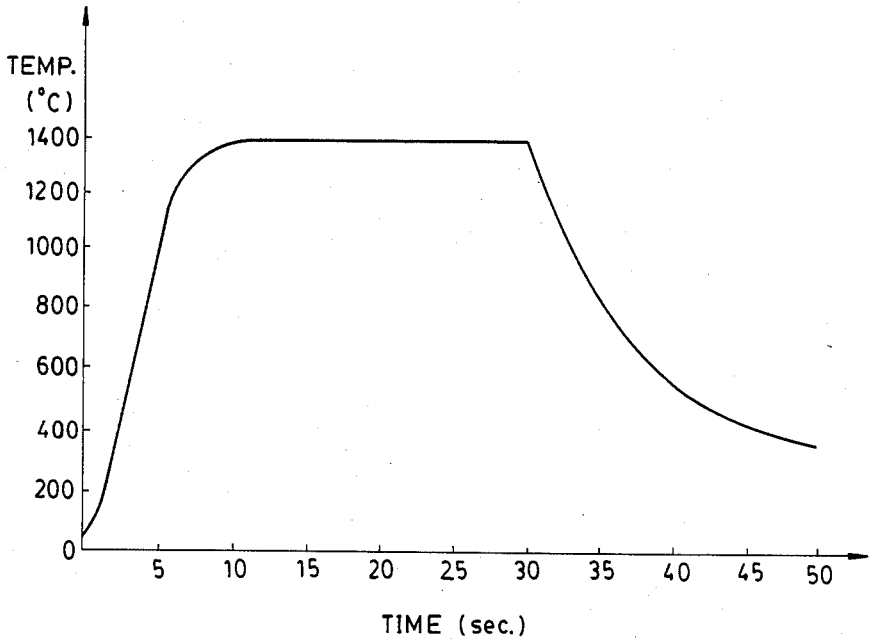
FIG. 6 is a diagram showing a characteristic curve of variations in temperature reached in an actual radiant heating furnace equipped with a plurality of halogen lamp units according to this invention.

Temperature-raising tests were carried out using the above radiant heating furnace. A temperature increase when each lamp 10 was supplied for 30 seconds with an electric power of 1600 W, which was one half of its rated power supply, was measured by a thermocouple bonded to a silicon wafer, the object, of 450 $\mu$m thick and 4 inches diameter set in the translucent quartz vessel and held at the center level position in the irradiation space 1. The temperature variation is diagrammatically illustrated in FIG. 6. Namely, the temperature reached as high as 1400° C. in 10 seconds after turning on the lamps 10. When the lamps 10 were supplied with their rated power supply, i.e., an electric power of 3200 W, 1400° C. was reached in 3 seconds after turning on the lamps 10. In each of the above tests, the surface layer of the silicon wafer was fused finally in a short period of time. It is important in the semiconductor processings to obtain such a high temperature as capable of fusing silicon wafers in a short period of time. Owing to the above feature, the halogen lamp unit according to this invention can be adapted to raise the temperature of a silicon wafer or the like having a large area in a short period of time, which was unfeasible in conventional heating furnaces.

Having now fully described the invention, it will be apparent to one of ordinary skill in the art that many changes and modifications can be made thereto without departing from the spirit or scope of the invention as set forth herein.

What is claimed is:

1. A halogen lamp unit comprising a plurality of halogen lamps arranged in a plane, each halogen lamp having a sealed tubular body including a tubular outer wall portion and two bare sealed end portion, each said lamp defining a length, and a conductive member at each said end portion, each end portion hermtically enclosing its respective conductive member, holders mounted on mirrors and adpated to hold the halogen lamps in place, each of said holders engaging said tubular outer wall portion adjacent to said end portions, said mirrors being cooled by a water-cooling system, and means for flowing cooling air generally parallel to the length of said lamps, said bare sealed end portions being exposed to the flow of said cooling air.

* * * * *

UNITED STATES PATENT AND TRADEMARK OFFICE

CERTIFICATE OF CORRECTION

PATENT NO. : 4,540,911

DATED : September 10, 1985

INVENTOR(S) : Tetsuji Arai and Tatsushi Igarashi

It is certified that error appears in the above-identified patent and that said Letters Patent is hereby corrected as shown below:

Column 6, Claim 1, line 48, "hermtically" should be --hermetically--; and

Column 6, Claim 1, line 50, "adpated" should be --adapted--.

Signed and Sealed this

*Fifteenth* Day of *April 1986*

[SEAL]

*Attest:*

DONALD J. QUIGG

*Attesting Officer*

*Commissioner of Patents and Trademarks*